United States Patent [19]

Bowley

[11] 4,207,056

[45] Jun. 10, 1980

[54] METHOD AND APPARATUS FOR IMPROVING THE FUEL EFFICIENCY OF A LAUNDRY DRYER

[76] Inventor: Robert J. Bowley, 124c R.D. 5 Tuckhoe Rd., Williamstown, N.J. 08094

[21] Appl. No.: 957,924

[22] Filed: Nov. 6, 1978

[51] Int. Cl.[2] ..... F27D 1/00; F27B 7/36

[52] U.S. Cl. ..... 432/3; 34/86; 34/131; 34/133; 432/105

[58] Field of Search ..... 432/3, 105, 199, 213; 34/86, 131, 133

[56] References Cited

U.S. PATENT DOCUMENTS

| | | | |
|---|---|---|---|
| 3,290,028 | 12/1966 | Kruzan | 432/105 |
| 3,959,892 | 6/1976 | Cloud et al. | 34/131 |
| 3,969,070 | 7/1976 | Thompson | 432/105 |
| 4,065,253 | 12/1977 | Bullock | 432/105 |

*Primary Examiner*—John J. Camby

[57] ABSTRACT

A laundry dryer of the type having a pair of upstream and downstream side-by-side gas burners is modified by the removal of the upstream burner and replacing the burner with a reheat plenum. The reheat plenum is generally tear-shaped in cross section to provide an inlet portion having a relatively large airflow cross sectional area located laterally adjacent the burner so that the recirculated airflow enters the reheat plenum at a relatively low velocity conducive to settlement of lint therein at a point in the plenum away from high temperature heat exchange relation with the burner. The lower wall of the reheat plenum is angularly inclined and preferably curvilinear in contour and extends above the downstream burner in flame deflecting and heat exchange relation therewith to heat the recirculated air within the reheat plenum. The reheat plenum also has a discharge portion of relatively smaller cross sectional area which injects the reheated air at relatively high velocity into the flow of heated makeup air to effect mixing of the reheated and makeup airflow.

2 Claims, 5 Drawing Figures

METHOD AND APPARATUS FOR IMPROVING THE FUEL EFFICIENCY OF A LAUNDRY DRYER

The invention relates to a laundry dryer and more particularly to a method and apparatus for improving the fuel efficiency of a laundry dryer.

BACKGROUND OF THE INVENTION

Conventional laundry dryers have a drying chamber in which a perforated drum is rotated to tumble the laundered goods. A combustion unit is provided for heating the ambient makeup air to a temperature suitable for drying the laundered goods. The combustion unit conventionally includes a pair of gas burners which are arranged in side-by-side relation in the airflow path between an ambient makeup air inlet and the drying chamber. A blower or the like is provided for circulating the heated air from the combustion unit through the drying chamber and exhausting the moisture-laden airflow to the environment.

It is known that the fuel efficiency of a laundry dryer may be improved by reclaiming heat from the moisture-laden exhaust airflow. For example, Cloud et al U.S. Pat. No. 3,959,892 introduces a portion of the exhaust airflow into the combustion chamber at a point downstream from the first and second burners and upstream of the inlet to the drying chamber.

Another prior art heat reclaimer for a laundry dryer is shown in Thompson U.S. Pat. No. 3,969,070. Thompson defines a recycle manifold by mounting a housing in spaced relation above the top wall of the combustion chamber to define an airflow passage in heat exchange relation with the top wall of the combustion chamber. A portion of the exhaust airflow is circulated through the recycle manifold and is then mixed with the heated makeup air immediately adjacent the inlet to the drying chamber.

One disadvantage of the prior art recirculating devices is that the recirculation of 45 to 75% of the moisture-laden exhaust airflow into the drying chamber substantially reduces the volume of makeup airflow to the two gas burners. Accordingly, the gas burners may be starved for makeup air with the result that the airflow in the combustion chamber my stagnate and a portion of the heat generated therein is lost by conduction through the walls of the dryer or through reverse airflow through the makeup air inlet. Furthermore, a so-called lazy flame condition may result in which the airflow across the burners is not sufficient to forcibly draw the combustion products toward the drying chamber inlet.

Furthermore, the aforedescribed prior art heat reclamation devices do not provide for entrapment of lint which may be present in the exhaust airflow, particularly where the lint filter of the dryer is not properly maintained.

SUMMARY OF THE INVENTION

The present invention relates to a new and improved method and apparatus for reclaiming exhaust heat in a laundry dryer by providing a reheat plenum adapted to replace one of the pair of burners and the reheat plenum is particularly designed to include a low velocity entry portion conducive to deposit therein of lint out of heat exchange relation with the remaining burner and having an inclined wall extending in overlying heat exchange relation with the remaining burner to heat the recirculated exhaust airflow within the reheat plenum and deflect the flame and combusted air makeup mixture toward the inlet of the drying chamber.

More particularly, according to the invention, a laundry dryer of the type having a pair of upstream and downstream side-by-side gas burners is modified by the removal of the upstream burner and replacing the burner with a reheat plenum. The reheat plenum is generally tear-shaped in cross section to provide an inlet portion having a relatively large airflow cross sectional area located laterally adjacent the burner so that the recirculated airflow enters the reheat plenum at a relatively low velocity conducive to settlement of lint therein at a point in the plenum away from high temperature heat exchange relation with the burner. The lower wall of the reheat plenum is angularly inclined and preferably curvilinear in contour and extends above the downstream burner in flame deflecting and heat exchange relation therewith to heat the recirculated air within the reheat plenum. The reheat plenum also has a discharge portion of relatively smaller cross sectional area which injects the reheated air at relatively higher velocity into the flow of heated makeup air to mix the reheated and makeup airflow.

Accordingly, one object, feature and advantage of the invention resides in the removal of one of the pair of gas burners and the replacement thereof by a reheat plenum.

Another object, feature and advantage of the invention resides in the provision of a reheat plenum having an inlet portion of relatively large cross sectional flow area conducive to the low velocity settlement of lint at a point laterally adjacent and away from high temperature heat exchange relation with the remaining gas burner.

A still further object, feature and advantage of the invention resides in the lower wall of the reheat plenum being inclined angularly and preferably curvilinearly in overlying heat exchange relationship with the burner to deflect the flame and products of makeup air and combusted gas toward the inlet to the drying chamber and away from the makeup air inlet.

Another object, feature and advantage of the invention resides in the provision of a reheat plenum having a discharge outlet of relatively small cross sectional flow area conducive to the high velocity injection of the reheated airflow into the heated makeup air.

BRIEF DESCRIPTION OF THE DRAWINGS

These and other objects, features and advantages of the invention will become apparent upon consideration of the appended drawings in which.

DESCRIPTION OF THE PREFERRED EMBODIMENT

Figure 1:
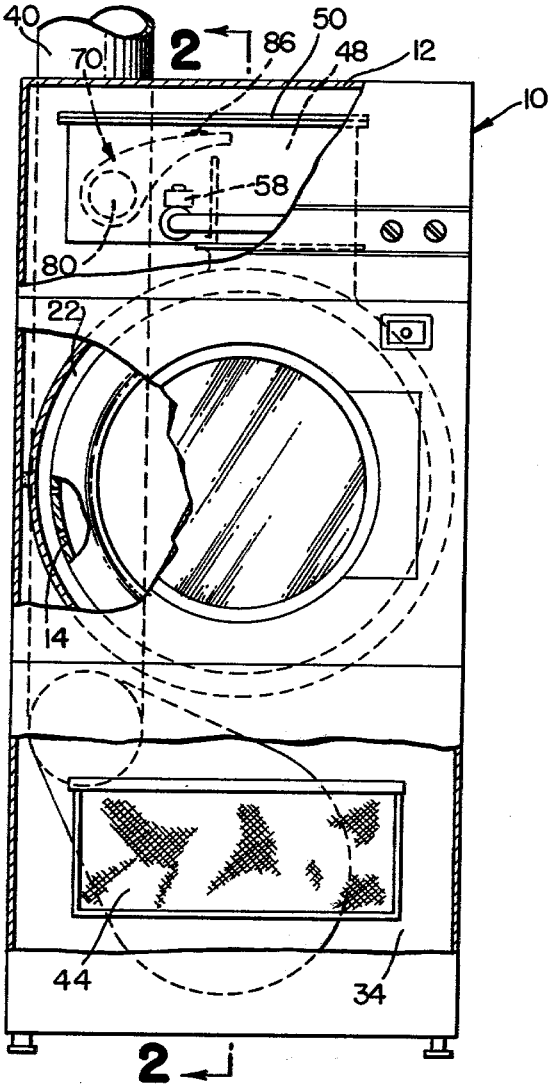
FIG. 1 is a front elevation view of a laundry dryer having parts broken away and in section.

Referring to FIG. 1, it is seen that the laundry dryer generally indicated at 10 has an exterior sheet metal cabinet 12 in which a perforated drum 14 is supported for rotation by a cantilevered shaft 16. Electric motor 18 is suitably coupled with the drum shaft 16 by a suitable chain driver and gear arrangement best seen in FIGS. 2 and 3 to rotate the drum 14 so that the laundered goods are tumbled therein. The drum 14 is situated within a cylindrical drying chamber 22 defined by an upper wall 24 having a drying chamber inlet opening 28 and a lower wall 26 having an outlet opening 30.

A blower 38 is mounted within an exhaust chamber 34 and is driven by the motor 18 to create an airflow stream or path from the drying chamber inlet opening 28, through the drying chamber 22 to the outlet opening 30, through the exhaust chamber 34, and through an exhaust duct 40 which communicates with the outdoor atmosphere. A suitable lint screen 44 is provided at the inlet of the blower 38.

Figure 5:
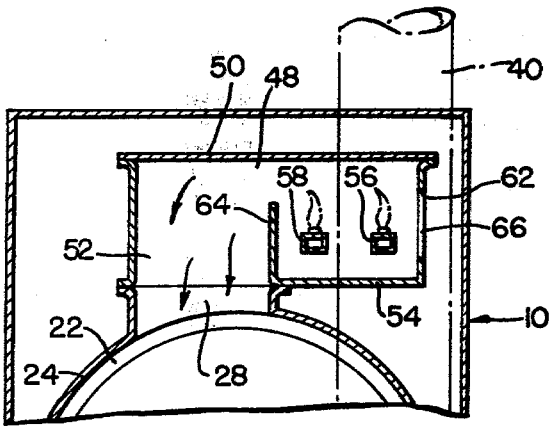
FIG. 5 PRIOR ART
FIG. 5 shows a prior art laundry dryer without an exhaust recirculation device.

As best seen in FIG. 5, a conventional prior art combustion chamber 48 is provided atop the drying chamber 22 and is defined by a sheet metal combustion box 50 having an outlet opening 52 which communicates with the inlet opening 28 of the drying chamber 22. A first upstream burner 56 and a second downstream burner 58 are mounted within the combustion chamber 48 in interposition between the combustion chamber outlet opening 52 and a makeup air inlet 62 in the sidewall 66 of the box 50. The makeup air inlet 62 may alternatively be located in the lower wall of the combustion box 50. Suitable additional openings are provided in the cabinet 12 to admit fresh ambient air to the combustion chamber makeup air inlet 62 to support combustion at the burners 56 and 58. The burners are preferably fired with natural gas and the combustion products of the mixed natural gas and makeup air are drawn over a baffle plate 64 and thence downwardly into drying chamber 22.

Figure 2:
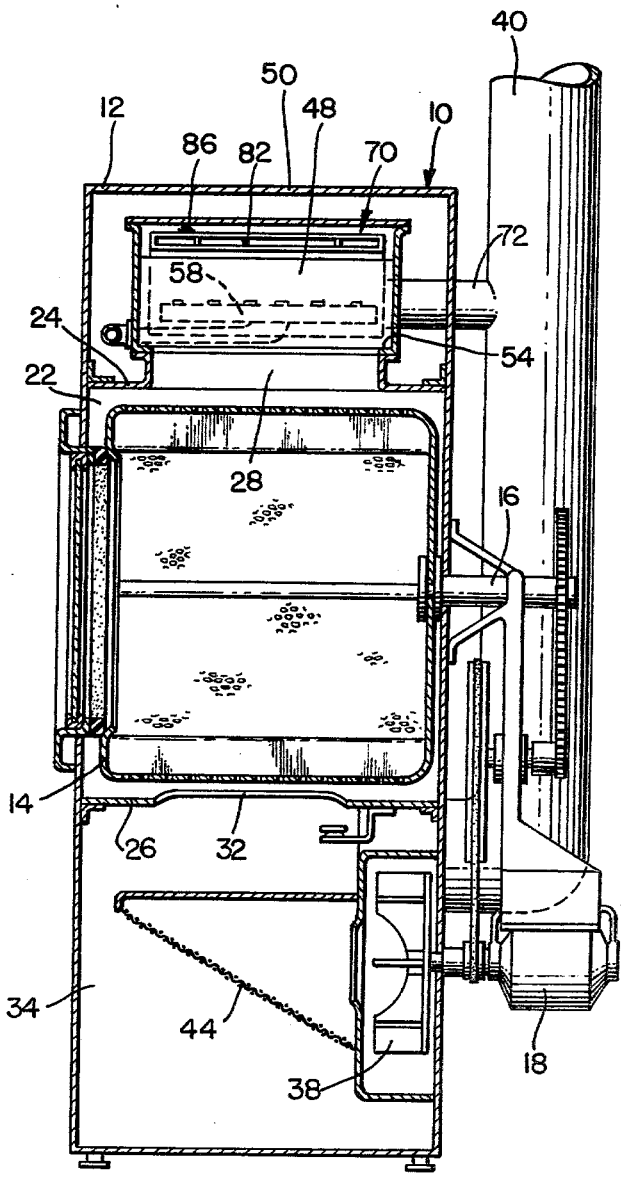
FIG. 2 is a sectional view taken in the direction of arrows 2—2 of FIG. 1.
Figure 3:
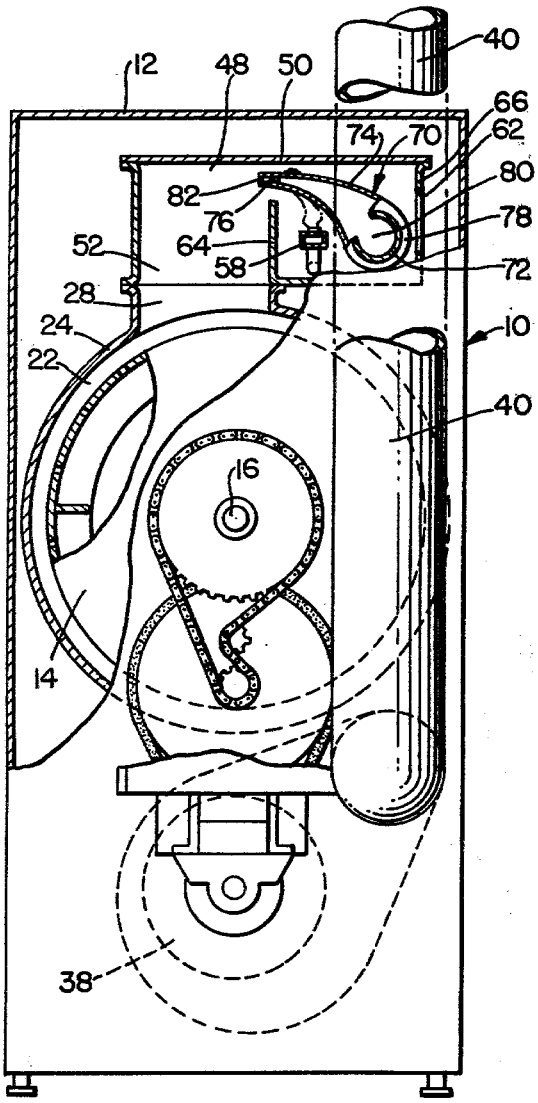
FIG. 3 is a view similar to FIG. 1 but showing a rear elevation of the dryer.
Figure 4:
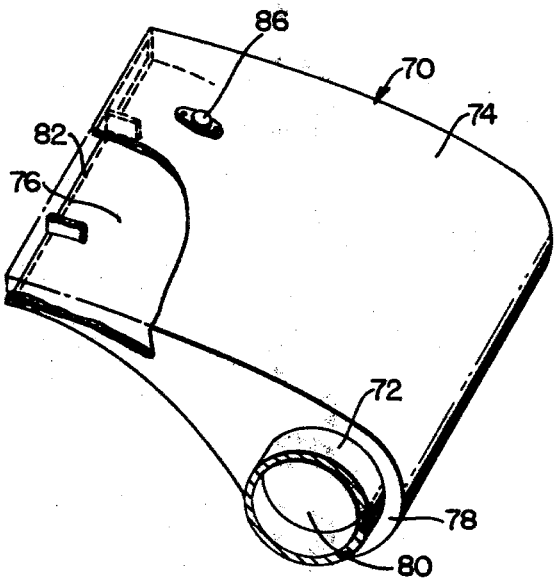
FIG. 4 is an enlarged perspective view showing the reheat plenum of this invention.

Referring again to FIGS. 1 and 3, it is seen that the present invention contemplates the removal of the upstream burner 56 which is furthest from the drying chamber inlet 28 as seen in FIG. 5. As best seen in FIGS. 3 and 4, a reheat plenum generally indicated at 70 is provided within the combustion chamber 48 generally within the space vacated by the burner 56. The reheat plenum 70 is generally shaped as an airfoil or tear drop. The reheat plenum 70 includes a curved upper wall 74 and a curved lower wall 76 which are connected at their lower ends by a curved end wall 78 to define an inlet portion 80 of relatively large cross sectional flow area which is located laterally adjacent the burner 58. The upper wall 74 and lower wall 76 of the reheat plenum converge toward one another to provide a gradually lessening cross sectional flow area and terminate at a discharge opening 82 located generally above the combustion box baffle plate 64. The reheat plenum 70 is generally the same length as the burner 58 as best seen in FIG. 2. The curved lower wall 76 of the reheat plenum 70 is inclined and extends in heat exchange relation above the burner 58 so that the lower wall is heated by the burner. The upper wall 74 of plenum 70 is spaced from the upper wall of the combustion box 50. A thermostatic switch 86 is attached to the top wall 74 of the plenum 70 and is electrically connected with the control circuit for the burner 58 to shut down the burner 58 in the event that a malfunction causes overheating of the dryer. A pair of stiffening ribs connect the upper wall 74 and lower wall 76.

Referring to FIG. 2, it is seen that an inlet pipe 72 connects the end wall of the plenum 70 with the exhaust duct 40. The size and location of the inlet pipe 72 is selected to recirculate about 45% of the moisutre-laden exhaust air from the exhaust duct 40 into the reheat plenum 70. Accordingly, the other 55% of airflow to the blower 38 is through the makeup air inlet 62 and supports combustion at the burner 58. The lower curved and inclined wall 76 of the reheat plenum 70 deflects the combustion products rising from the burner 58 over the baffle 64 and into the combustion chamber outlet opening 52. It is important to note that the low velocity inlet portion 80 of the reheat plenum 70 is conducive to the settlement therein of the lint which may have escaped the lint filter 44. The lint is deposited in this inlet portion 80 of reheat plenum away from that portion of the lower wall 76 which is in heat exchange relation with the combustion products of the burner 58. Accordingly, the heat transfer effectiveness of the reheat plenum will not be impaired by deposit of lint or other foreign matter on the heat exchange surface. The accumulated lint, if any, may be removed through the inlet pipe 62 or through a suitable cleanout opening, not shown.

Thus, it is seen that the invention provides a new and improved method and apparatus for reclaiming exhaust heat in a laundry dryer by replacing one of the pair of burners with a reheat plenum of tear-shaped cross section including a low velocity entry portion conducive to deposit of lint away from heat exchange relation with the remaining burner and having an inclined lower wall extending in overlying heat exchange relation with the remaining burner to heat the recirculated exhaust airflow and deflect the flame and combusted air makeup mixture toward the inlet of the drying chamber.

While this invention has been disclosed primarily in terms of the specific embodiments shown in the drawings, it is not intended to be limited thereto, but rather only to the extent set forth in the appended claims.

The embodiments of the invention in which an exclusive property or privilege is claimed are defined as follows:

1. A method of improving the fuel efficiency of a laundry dryer of the type having a combustion chamber wherein first and second burners are located laterally adjacent one another in a path of airflow from an ambient makeup air inlet adjacent and upstream from the first burner to a drying chamber inlet adjacent and downstream from the second burner, and having a blower exhausting moisture-laden airflow from the drying chamber to an exhausting duct, comprising the steps of:

removing the first burner adjacent the ambient air makeup inlet:

installing a recirculation duct for recirculating a portion of the exhaust airflow from the exhaust duct to the combustion chamber;

and installing a reheat plenum in the combustion chamber space vacated by removal of the first burner, said reheat plenum being fabricated of walls independent of the combustion chamber and having an inlet portion of relatively large cross sectional flow area located laterally adjacent the second burner and communicating with the recirculating duct to receive exhaust airflow at relatively low velocity at a point laterally adjacent and away from high temperature heat exchange relation with the second burner, said reheat plenum having an angularly inclined lower heat exchange surface overlying the second burner in high temperature heat exchange and flame deflecting proximity therewith to heat the recirculating exhaust airflow within the reheat plenum and deflect the ambient makeup airflow across the second burner, and said plenum having a relatively smaller cross section discharge opening for injecting the reheated recirculated exhaust airflow into the flow of heated makeup air at relatively higher velocity.

2. In a laundry dryer having a combustion chamber receiving makeup airflow from an air makeup inlet, a burner located in the combustion chamber for heating the makeup airflow, a drying chamber in which laundry is tumbled, and blower means for establishing a stream of airflow from the air makeup inlet, through the combustion chamber and drying chamber, and exhausting moisture-laden airflow to an exhaust duct, the improvement comprising:

a reheat plenum mounted in the combustion chamber, said reheat plenum having spaced apart upper and lower walls defining an inlet portion having a relatively large cross sectional flow area located laterally adjacent the burner and upstream therefrom in airflow interpostioned between the makeup air inlet and the burner, a recirculation duct connecting the exhaust duct with the inlet portion of the reheat plenum to introduce a portion of the exhaust airflow into the reheat plenum at a relatively low velocity permitting the settlement of lint on the lower wall laterally spaced away from high temperature heat exchange relation with the burner, said reheat plenum lower wall overlying the burner in heat exchange relation therewith to heat the recirculating exhaust airflow within the reheat plenum and being inclined to deflect the burner flame and combustion products toward the drying chamber said plenum having a discharge opening of relatively smaller cross sectional flow area than the inlet portion and located downstream from the burner so that the reheated airflow is accelerated within the reheat plenum and injected through the discharge opening into the flow of makeup air heated by the burner.

* * * * *